United States Patent [19]

Peers-Trevarton

[11] Patent Number: 4,540,236

[45] Date of Patent: Sep. 10, 1985

[54] QUICK LOCK/QUICK RELEASE CONNECTOR

[75] Inventor: Charles A. Peers-Trevarton, Coral Springs, Fla.

[73] Assignee: Cordis Corporation, Miami, Fla.

[21] Appl. No.: 514,684

[22] Filed: Jul. 18, 1983

[51] Int. Cl.[3] ..... H01R 13/635

[52] U.S. Cl. ..... 339/45 R; 339/74 R; 339/258 R

[58] Field of Search ..... 339/74 R, 45 R, 45 M, 339/258 R, 258 P, 75 A, 113 R; 128/419 P

[56] References Cited

U.S. PATENT DOCUMENTS

| | | | |
|---|---|---|---|
| 2,944,241 | 7/1960 | Londell, Jr. | 339/74 R |
| 3,493,917 | 2/1970 | Glowacz | 339/74 R |
| 3,760,332 | 9/1973 | Berkovits et al. | 128/419 P |
| 3,822,707 | 7/1974 | Adducci et al. | 128/419 |
| 3,908,668 | 9/1975 | Bolduc | 128/419 |
| 3,951,154 | 4/1976 | Hartlaub | 128/419 |
| 4,027,678 | 6/1977 | van Oostveen et al. | 128/419 |
| 4,072,154 | 2/1978 | Anderson et al. | 128/419 |
| 4,105,037 | 8/1978 | Richter et al. | 128/419 |
| 4,112,953 | 9/1978 | Shanker et al. | 128/419 |
| 4,141,752 | 2/1979 | Shipko | 128/419 |
| 4,142,532 | 3/1979 | Ware | 128/419 |
| 4,152,540 | 5/1979 | Duncan et al. | 174/152 |
| 4,154,248 | 5/1979 | Jones | 128/419 |
| 4,195,897 | 4/1980 | Plevjak | 339/45 R |
| 4,202,592 | 5/1980 | Rullier et al. | 339/116 |
| 4,226,244 | 10/1980 | Coury et al. | 128/419 |
| 4,236,525 | 12/1980 | Sluetz et al. | 128/419 |
| 4,248,237 | 2/1981 | Kenny | 128/419 |
| 4,259,962 | 4/1981 | Peers-Trevarton | 128/419 |

FOREIGN PATENT DOCUMENTS

| | | | |
|---|---|---|---|
| 1188558 | 9/1959 | France | 339/45 R |

*Primary Examiner*—John McQuade

*Attorney, Agent, or Firm*—Henry W. Collins; Thomas R. Vigil

[57] ABSTRACT

The quick lock/quick release connector is fixed within a socket in a neck of a pacer and includes gripping members for gripping a terminal pin at the distal end of a terminal electrode assembly inserted in the socket and for establishing good mechanical and electrical connection with the terminal pin. The connector further includes a mechanism for manipulating the gripping members from the outside of the pacer body to release the grip of the gripping members on the terminal pin.

17 Claims, 6 Drawing Figures

QUICK LOCK/QUICK RELEASE CONNECTOR

FIELD OF THE INVENTION

The present invention relates to a connector to be utilized in a pacer assembly and more particularly to a quick lock/quick release connector for effecting a good electrical and mechanical connection with a lead terminal pin within a socket in the neck of the pacer.

DESCRIPTION OF THE PRIOR ART

Heretofore various connector devices have been proposed for effecting a mechanical and electrical connection with a lead terminal pin of a pacing lead assembly in a socket within the neck of a pacer.

Examples of such prior art devices are found in the following U.S. Pat. Nos.:

| U.S. PAT. NO. | PATENTEE |
|---|---|
| 3,822,707 | Adducci et al. |
| 3,908,668 | Bolduc |
| 3,951,154 | Hartlaub |
| 4,027,678 | van Oostveen et al. |
| 4,072,154 | Anderson et al. |
| 4,105,037 | Richter et al. |
| 4,112,953 | Shanker et al. |
| 4,141,752 | Shipko |
| 4,142,532 | Ware |
| 4,152,540 | Duncan et al. |
| 4,154,248 | Jones |
| 4,202,592 | Rullier et al. |
| 4,226,244 | Coury et al. |
| 4,236,525 | Sluetz et al. |
| 4,248,237 | Kenny |
| 4,259,962 | Peers-Trevarton |

The Adducci U.S. Pat. No. 3,822,707 discloses a pacer including a pulse generator, electrodes and electrode leads coupling the pulse generator to the electrodes. The pulse generator is battery powered by a solid state lithium battery providing for a compact product. The leads are retained in place within the device by a potting compound such as a high temperature thermosetting substance, e.g., an epoxy.

The Bolduc U.S. Pat. No. 3,908,668 discloses a tissue stimulator with a sealed lead connector engageable and operable by a tool for connecting the lead to a pulse generator. The connector comprises a block having a receptacle bore for receiving the lead terminal pin and a retaining mechanism comprising a socket set screw in a threaded bore in operative relationship with the receptacle in the connector block for fixing the pin in the socket.

The Hartlaub U.S. Pat. No. 3,951,254 discloses a lead connector for an electro-medical device, the connector having an electrically insulating barrier which results in an open circuit such that current cannot flow through the connector from the power source until the lead is inserted therein. The connector is a bifurcated structure, with the lead pin, when inserted, providing an electrically conductive bridge from one conductive section of the connector to the other thus bypassing the insulating layer. A set screw is utilized to hold the lead pin in place within the connector.

The van Oostveen et al. U.S. Pat. No. 4,027,678 discloses a connector for connecting a pin electrode to a pacer within a socket in the pacer where the pacer and the pin electrode are derived from different manufacturers and are not normally adapted for connection to one another. The connector has a coil therein dimensioned to receive the pronged end of a pin electrode and has a smaller diameter pin extending therefrom for being received in the pacer socket. The connector is adapted to permit connection or disconnection as the connector is rotated.

The Anderson et al. U.S. Pat. No. 4,072,154 discloses a sealing arrangement for heart pacer electrode leads in a pulse generator within which a terminal pin is arranged to be clamped between a set screw and a terminal post. A peripheral seal arrangement permits substantial canting and deflection of the lead assembly within a tubular bore formed in the pulse generator without adversely affecting the sealing conditions and with ease of insertion facilitated due to the increased tolerances which may be employed between the inner end of the lead and a pulse generator connector block.

The Richter et al. U.S. Pat. No. 4,105,307 discloses a releasable electrical connection for an electrode lead of an implantable artificial cardiac pacemaker. The releasable electrical connection including a plug connected to the lead and a mating receptacle provided with conical seating surfaces and a socket for connection to an electrode extending from the plug. The end of a helical conductor of the electrode lead is secured within the plug by means of a screw which is sealed within the plug.

The Shanker U.S. Pat. No. 4,112,953 discloses a pacer stimulator with an improved lead connector, the improvement comprising a connector having frictionally engaging surfaces formed by a number of helically extending tensioned metal strands within which a male connector of the lead is received.

The Shipko U.S. Pat. No. 4,141,752 discloses an organ stimulating apparatus in which a catheter extends through a threaded cavity or socket and is held by an electrically insulated set screw that is screwed into the cavity and seals the cavity against the penetration of body fluids.

The Ware U.S. Pat. No. 4,142,532 discloses a body implantable stimulator with a novel connector. The novel connector is a preformed connector within which several conductors and a pin are mechanically connected by means of a set screw which is tightened against the pin, with the pin being urged against the conductors.

The Duncan U.S. Pat. No. 4,152,540 discloses a connector for use in an implantable cardiac pacer. A heart lead is inserted into the pacer housing and through a hole in the connector and is held in the connector by means of a screw.

The Jones U.S. Pat. No. 4,154,248 discloses a body implantable electrical stimulator having a separable lead and a signal generator. The signal generator includes a jack for accepting a portion of the lead to secure it to the generator. In a preferred embodiment, the lead is provided with a pin and the jack includes a terminal for engagement with the pin. The jack further includes a viewing port which facilitates the viewing of the engagement of the pin and terminal.

The Rullier et al. U.S. Pat. No. 4,202,592 discloses a sealed electrical connector comprising an electrically insulated pin housed in a receptacle and having a bared end for contact with a conductor extending partly out of the receptacle. An adjustable mechanical mechanism is utilized to lock the pin to the receptacle and comprises a screw engaged in a tapped hole in the receptacle.

The Coury et al. U.S. Pat. No. 4,226,244 discloses a preformed connector with an encapsulated terminal for attachment to a pacer. The preformed connector eliminates the use of epoxy or other similar substances to encapsulate the terminal after attachment of the terminal to the pacer by means of set screws.

The Sluetz et al. U.S. Pat. No. 4,236,525 discloses a proximal connector of a pacing lead assembly which connector is mounted in a socket in a pacer neck and is movable to change connections between contacts on the connector and contacts in the socket thereby to change the function of distal electrodes coupled by a pacing lead to the connector contacts. The connector may incorporate a sealing ring to firmly hold the proximal connector within the generator socket.

The Kenny U.S. Pat. No. 4,248,237 discloses a cardiac pacemaker wherein an electrode catheter is connected to the pacemaker casing and held therein by a barb and rib type frictional retention arrangement.

The Peers-Trevarton U.S. Pat. No. 4,259,962 discloses a tubular connector which is connected to the proximal end of a pacing lead assembly and which has axially spaced inner and outer resilient rings for sealing engagement with a socket wall in a pacer neck.

As will be described in greater detail hereinafter, the quick lock/quick release connector of the present invention differs from the structures disclosed above by providing a structure which permits quick and simple connection of a proximal lead terminal electrode pin to a pacer assembly with no need for tools.

Further, the terminal pin is irremovably gripped in the socket assembly without any deformity to the tip being incurred. Also, removal of the terminal pin is simply achieved and, in the event the terminal pin becomes stuck within the socket, the terminal pin can be urged gently outwardly therefrom without special tools or damage to the lead or pin as will be described in greater detail hereinafter.

SUMMARY OF THE INVENTION

According to the invention there is provided a terminal pin connector assembly for a pacer having a socket for receiving a terminal electrode assembly with a terminal pin having an annular groove therein, said connector assembly comprising a terminal pin with an annular groove therein, quick lock/quick release connector means positioned in the socket and having means for resiliently and snap fittingly engaging in the groove in said terminal pin received in the socket for making a good mechanical and electrical connection with said terminal pin and means manually manipulatable without the aid of a tool from the outside of the pacer for actuating the engaging means to release the mechanical grip thereof on said terminal pin.

DESCRIPTION OF THE PREFERRED EMBODIMENT

Figure 1:
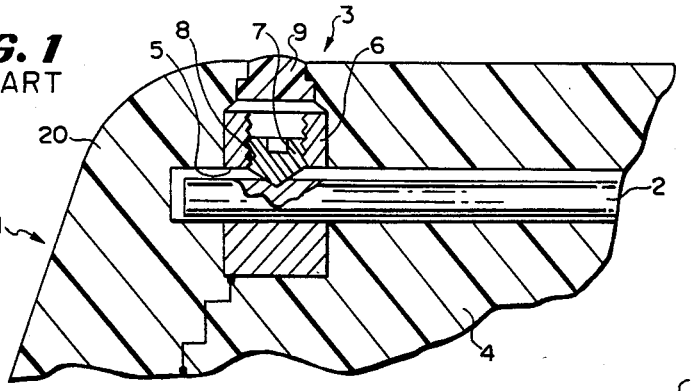
FIG. 1 PRIOR ART
FIG. 1 is a vertical sectional view of a prior art arrangement for attaching a pacing lead to a pacer body within a socket in the body.

Referring now to the drawings in greater detail there is illustrated in FIG. 1 a prior art arrangement for connecting a terminal pin 2 within a socket 3 in a pacer body 4.

In this arrangement, the terminal pin 2 is received within a bore 5 in a metal block 6 within the body 4. The bore 5 forms part of the socket 3. A metal screw or bolt 7 is received in a transverse bore 8 in the block 6. As the screw or bolt 7 is tightened with a wrench or the like into the metal block 6, it makes mechanical and electrical contact with the metal terminal pin 2 positioned within the socket 3. Once the connection has been formed satisfactorily, a seal plug 9 is placed in the bore 8 over the head of the screw 7 to plug the bore 8, through which the wrench was inserted, to protect the pacer body 4 and components therein from body fluids.

This procedure for connecting and disconnecting the pin 2 to and from the body 4 is tedious and time consuming and, at times, problems with the connection are incurred. For example, the screw 7 tends to deform, burr or mark the terminal pin 2, thus shortening its useful life. In this respect, if the terminal electrode pin 2 becomes deformed, later electrical connections can be loose or not formed at all due to the deformity of the pin 2 in the area of the connection.

Further, if the seal plug 9 over the screw 7 becomes loosened, body fluids may find their way into the pacer body 4 and the pin 2 can become stuck in the socket 3 and difficult to remove. If the pin 2 does in fact become stuck, it can only be removed by use of a special tool, which tool usually damages the neck of the pacer body 4.

Figure 2:
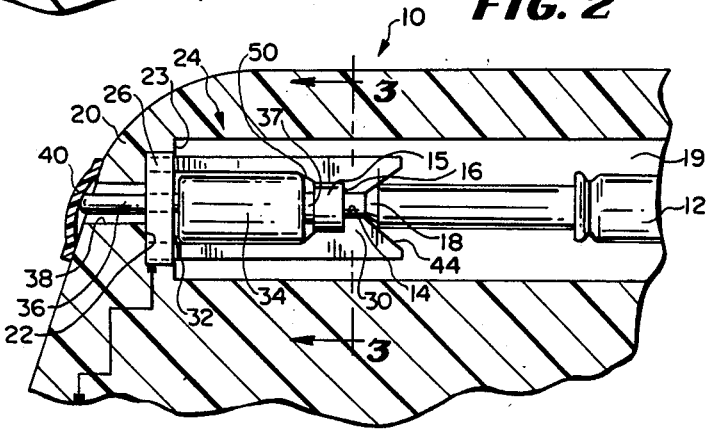
FIG. 2 is a vertical sectional view of part of a pacer body and shows a quick lock/quick release connector constructed according to the teachings of the present invention in gripping engagement with a lead terminal pin in a socket in the pacer body.

Referring now to FIG. 2, there is illustrated therein a quick lock/quick release connector which is constructed according to the teachings of the present invention and which is generally identified by reference numeral 10. The connector 10 is particularly adapted to grip and make a mechanical and electrical connection with a lead terminal pin 12 having a peripheral groove 14 machined therein behind a tip 15 thereof. A distal edge 16 of the groove 14 is formed radially perpendicular to the axis of the pin 12 while a proximal edge 18 of the groove 14 is formed at an angle which is obtuse to the axis of the pin 12.

Also as shown, the pin 12 is received in a socket 19 in a neck portion 20 of a pacer 21. The connector 10 is fixed in (such as by a press fit and/or an adhesive), and extends from, a cylindrical cavity 22 which opens onto a rear end wall 23 of the socket 19 and includes a snap lock socket forming assembly 24 adapted to engage and hold the terminal pin 12.

The snap lock socket forming assembly 24 includes a ring shaped electrode or contact 26 which is mounted in cavity 22 and which is electrically connected to pacer circuitry (not shown). Extending from the electrode 26 along the periphery thereof are a plurality of, and preferably four, flexible metal fingers 28 which are configured to positively engage the terminal pin 12 with claw shaped fee ends 30 of the fingers 28 or simply claws 30.

A cylindrical envelope 32 is defined within the fingers 28 within which is slidably received a cylindrical plunger 34.

Extending axially rearwardly from the plunger 34 is a pin 36 and extending axially forwardly from the plunger 34 is a button 37 which abuts against the tip 15 of the terminal pin 12 for limiting insertion of terminal pin 12 into the socket forming assembly 24 thereby properly to locate the claws 30 in the groove 14.

From the proximal end of the plunger 34, the pin 36 extends through ring electrode 26 and through a bore 38 within the pacer neck 20.

When the plunger 34 is at its most rearward position, the free end of the pin 36 extends outwardly of the pacer neck 20. As shown, a silicone elastomer flexible sealing disc 40 is fixed over the bore 38 in the pacer neck 20 and over the pin 36.

The flexible sealing disc 40 can be permanently fixed to the neck 20 of the pacer 21 by hermetic sealing. By providing such a permanently fixed sealing disc 40, the components within the pacer body are protected from body fluids.

Figure 3:
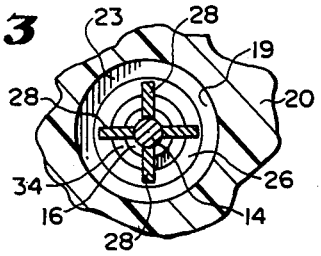
FIG. 3 is a vertical sectional view through the connector shown in FIG. 2 and is taken along line 3—3 of FIG. 2.

Referring now to FIG. 3, there is illustrated therein a longitudinal cross-sectional view of the assembly 10 taken along line 3—3 of FIG. 2.

As shown, the four metal fingers 28 are spaced apart approximately 90° with the claws 30 received within the machined groove 14 in the lead terminal pin 12.

Further, received within the cylindrical envelope 32 formed within the fingers 28 is the tip 15 of the terminal pin 12 and the plunger 34. As shown, the fingers 28 extend forwardly from the electrode 26 which is situated at rear end 22 of the socket 19.

When connecting the lead terminal pin 12 to the assembly 24, the tip 15 of the terminal pin 12 is inserted into the socket 19 and abuts the metal fingers 28 acting on a first sloping edge 44 of each finger 28 at the claw end 30 thereof to cause the fingers 28 to flex outwardly. As the terminal pin 12 is pushed further into the socket 19, the claws 30 of the fingers 28 become coincident with or come in registry with the machined groove 14 in the lead terminal pin 12 and the fingers 28 snap inwardly. The claws 30 of the fingers 28 are configured to positively engage in the machined groove 14 in the lead terminal pin 12 to hold the pin 12 in place.

To keep the pin 12 from moving further into the assembly 24, the tip 15 of the pin 12 comes into abutting engagement with the distal end of the button 37 extending from the plunger 34.

Further, to keep the terminal pin 12 from moving out of the socket 19, the claw shaped free end 30 of the fingers 28 are each provided with an inner perpendicular shoulder formation 48 which engages perpendicular edge 16 of the groove 14 machined into the lead terminal pin 12.

As the lead terminal pin 12 becomes positively engaged within the claws 30, a tactile as well as audible "click" indicates that the lead is engaged as the claws 30 snap inwardly and are received within the groove 14 on the lead terminal pin 12.

Due to this positive engagement of the pin 12 within the assembly 24, it is necessary to provide a mechanism whereby the pin 12 can be disengaged from the assembly 24 without damage to the pin 12.

To enable such disengagement of the pin 12, the plunger 34 with the pin 36 extending therefrom are provided, the actuation of which will be described below. Preferably, the plunger 34 is made of a plastic non-conductive material to prevent conduction of any electrical signal through same.

As stated above, once the lead terminal pin 12 is engaged within the assembly 24, it cannot be pulled out due to abutment of the perpendicular shoulder 48 of each claw 30 against perpendicular edge 16 of the groove 14.

In order to remove the lead terminal 12 from engagement within the assembly 24, the fingers 28 must flex outwardly to disengage shoulder formation 48 from the groove 14.

Figure 4:
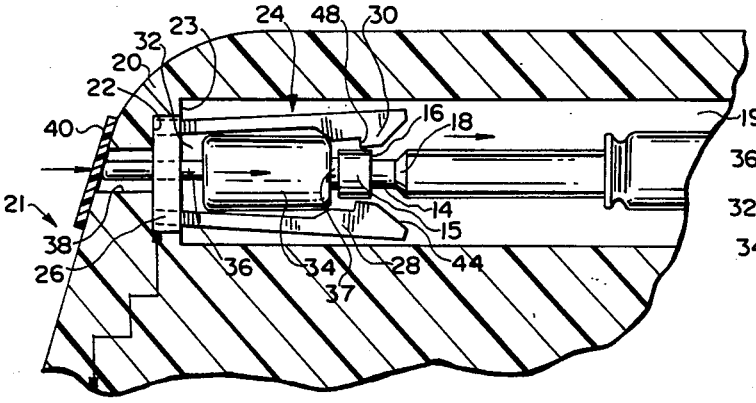
FIG. 4 is a vertical sectional view of the connector similar to the view shown in FIG. 2 and shows the lead terminal pin being disconnected from the connector.

Referring now to FIG. 4, this is accomplished by applying pressure through sealing disc 40 against pin 36 thus urging plunger 34 forwardly within the cylindrical envelope 32. As plunger 34 moves forwardly within the cavity 32, it engages an angled or inclined shoulder formation 50 at the rearward end of each claw 30.

As the plunger 34 moves along angled shoulder formation 50, the fingers 28 are caused to flex outwardly and away from the axis of the terminal pin 12 gradually releasing engagement of the claws 30 in the groove 14. Once the plunger 34 reaches the end of the shoulder 50, the terminal pin 12 is easily removed.

Further, if for some reason the terminal pin 12 should become stuck within the assembly 24, the proximal end of the button 37 which abuts the terminal pin 12, urges the pin 12 out of the assembly 24 thus aiding its disengagement and removal.

Figure 5:
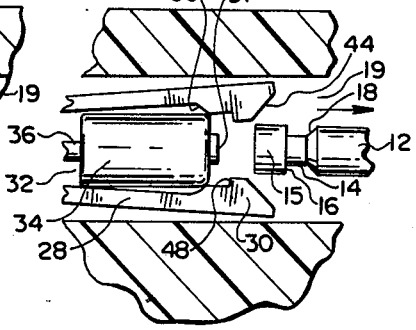
FIG. 5 is a fragmentary sectional view of the connector similar to the view shown in FIG. 4 and shows the lead terminal pin disconnected from the connector.

Referring now to FIG. 5, as the plunger 34 reaches the end of the angled shoulder 50, terminal pin 12 is completely disengaged from the assembly 24. Once the pin 12 is completely disengaged from the assembly 24, pressure on the button 36 is released and the plunger 34 is urged back to its rearward position by the action of the angled shoulder formation 50 against the plunger 34 as the fingers 28 flex back toward the axis of the assembly 24.

Figure 6:
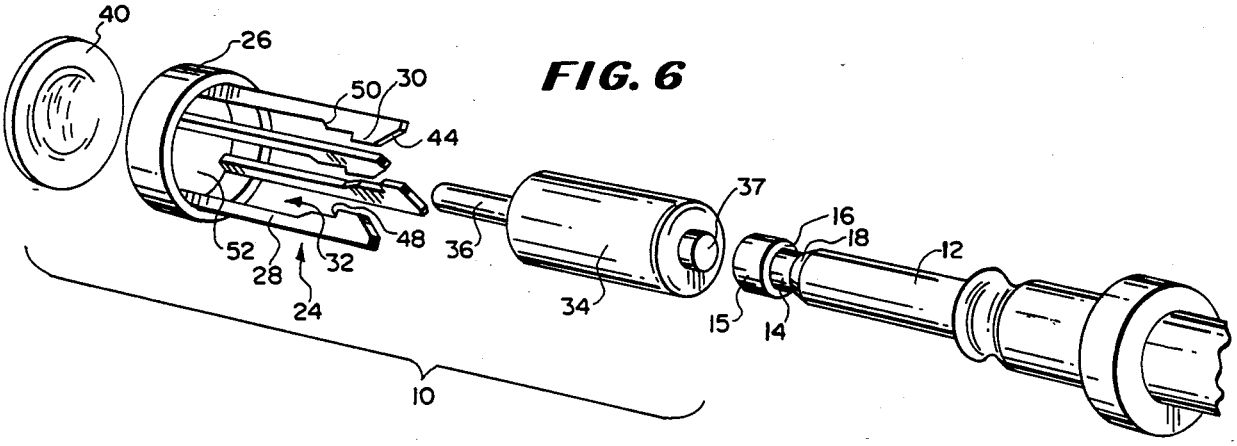
FIG. 6 is an exploded perspective view of the connector of the present invention.

Referring now to FIG. 6, there is illustrated therein an exploded perspective view of the connector 10 of the present invention.

As shown, the connector 10 of the present invention is comprised of the socket forming assembly 24 having the ring electrode 26 from which flexible fingers 28 extend. Formed within the fingers 28 is the cylindrical envelope 32 within which is received the plunger 34. A proximal end of the button 37 abuts the tip 15 of the lead terminal pin 12 while claws 30 of the fingers 28 mate with the groove 14 when the terminal pin 12 is held in place within the assembly 24. The flexible sealing disc 40 is provided to hermetically seal bore 38 within neck 20 of pacer 21 through which extends the distal end of the pin 36 to seal the interior components within the pacer body off from body fluids.

As will be seen from the above description, the quick lock/quick release connector 10 of the present invention has a number of advantages, some of which have been described above and others of which are inherent in the invention.

First of all, no tools are required to form the connection. Further, since no tools are required, there is no removable seal needed which can loosen and allow penetration of body fluids into the pacer body. Since body fluids cannot enter through a loosened seal, sticking of the terminal pin 12 within the assembly is minimized if not altogether eliminated.

However, if the terminal pin 12 should become stuck for any reason, the button 36 and plunger 34 assist in urging the terminal pin 12 out of the assembly 24.

Also, with the connector of the present invention, there is no forced contact of the terminal pin 12 against any conductive element by a screw and thus no deformity or burring of the terminal pin.

Still further, in previously proposed assemblies, the electrical and mechanical connection, once formed, needed testing because the connection was often formed "blindly" in that the user could not see whether the lead had been inserted far enough into the pacer neck or whether the screw had in fact formed an electrical connection between a conductive sleeve and the terminal pin of the assemblies.

However, in using the connector of the present invention, a tactile as well as audible click indicates to the user that the lead terminal pin has been positively engaged within the assembly 24 as the claws 30 of the fingers 28 snap into the groove 14 machined into terminal pin 12. In other words, no testing of the connection formed with the connector 10 of the present invention is needed.

Also, since the connection is formed by a snap-type fit of the lead terminal pin 12 within the assembly 24, it is a very quickly and easily formed connection.

From the foregoing description, it will be apparent that modifications can be made to the quick lock/quick release connector of the present invention without departing from the teachings of the present invention. Accordingly, the scope of the invention is only to be limited as necessitated by the accompanying claims.

I claim:

1. A terminal pin connector assembly for a pacer having a socket for receiving a terminal electrode assembly with a terminal pin having an annular groove therein, said connector assembly comprising a terminal pin with an annular grooves therein, quick lock/quick release connector means positioned in the socket and having means for resiliently and snap fittingly engaging in the groove in said terminal pin received in the socket for making a good mechanical and electrical connection with said terminal pin and means manually manipulatable without the aid of a tool from the outside of the pacer for actuating the engaging means to release the mechanical grip thereof on said terminal pin.

2. The connector assembly of claim 1 wherein said engaging means includes means for producing a telltale audible click when said engaging means engages in the annular groove in said terminal pin to indicate to the user of the connector assembly that the terminal pin has been electrically and mechanically engaged.

3. The connector assembly of claim 1 wherein said engaging means comprise a ring shaped electrical and mechanical coupling member having a plurality of flexible fingers extending axially therefrom within the pacer socket.

4. The connector assembly of claim 3 wherein said plurality of flexible fingers comprises at least three and preferably four flexible fingers.

5. The connector assembly of claim 3 wherein said flexible fingers are spaced equidistantly around the ring shaped electrical and mechanical coupling member.

6. The connector assembly of claim 3 wherein each one of said flexible fingers has a claw on the free end thereof configured to be received within the annular groove in said terminal pin in a snap lock manner to positively engage the terminal pin.

7. The connector assembly of claim 6 wherein each claw has a shoulder extending generally radially inwardly toward the axis of the ring shaped electrical and mechanical coupling member for engaging an edge of the annular groove in the terminal pin.

8. The connector assembly of claim 3 wherein said fingers define a generally cylindrical envelope.

9. The connector assembly of claim 8 wherein a plunger is received within said cylindrical envelope within said fingers.

10. The connector assembly of claim 9 wherein each of said fingers has a claw at the free end thereof and an inwardly facing cam surface adjacent said claw, and said plunger is slidable within the cylindrical envelope for engaging said cam surfaces of said fingers to cause said fingers to flex radially outwardly to release engagement of said electrical and mechanical coupling member in the annular groove of said terminal pin.

11. The connector assembly of claim 10 wherein said plunger has a pin which extends axially rearwardly from said plunger.

12. The connector assembly of claim 11 wherein a free end of said pin extends through said ring shaped electrical and mechanical coupling member, through a bore in the pacer, and terminates at a location exterior of the pacer, said pin defining said manually manipulatable means.

13. The connector assembly of claim 12 wherein said manually manipulatable means further includes a flexible sealing disc hermetically sealed to the outer surface of the pacer about the bore therein.

14. The connector assembly of claim 13 wherein said flexible sealing disc is made of silicone elastomer material.

15. The connector assembly of claim 13 wherein said free end of said pin engages said sealing disc whereby depression of said disc forces said plunger against said fingers to cause said claws to disengage from the annular groove of the terminal pin.

16. The connector assembly of claim 12 wherein said plunger has a button at the forward end thereof which is adapted to abut against the terminal pin and which is adapted to act upon and urge the terminal pin out of its engagement within said connector means when said pin is pushed into the bore in the pacer.

17. The connector assembly of claim 13 wherein said fingers are resilient such that said cam surfaces will push said plunger to its rearward position once pressure is released on said sealing disc.

* * * * *